US011685016B2

(12) United States Patent
McLain et al.

(10) Patent No.: US 11,685,016 B2
(45) Date of Patent: Jun. 27, 2023

(54) COOLING DEVICE FOR A ROTATING POLISHING DISK

(71) Applicant: Lake Country Tool, LLC, Oconomowoc, WI (US)

(72) Inventors: Scott S. McLain, Mukwonago, WI (US); Charles B. Kendall, III, Brookfield, WI (US)

(73) Assignee: Lake Country Tool, LLC, Oconomowoc, WI (US)

( * ) Notice: Subject to any disclaimer, the term of this patent is extended or adjusted under 35 U.S.C. 154(b) by 975 days.

(21) Appl. No.: 16/550,620

(22) Filed: Aug. 26, 2019

(65) Prior Publication Data

US 2021/0060729 A1 Mar. 4, 2021

(51) Int. Cl.
*B24B 23/02* (2006.01)
*B24B 41/047* (2006.01)
*B24B 55/02* (2006.01)

(52) U.S. Cl.
CPC ..... *B24B 55/02* (2013.01); *B24B 23/02* (2013.01); *B24B 41/047* (2013.01)

(58) Field of Classification Search
CPC ..... B24B 23/02; B24B 23/028; B24B 23/03; B24B 23/04; B24B 41/047; B24B 55/02; B24D 9/08
See application file for complete search history.

(56) References Cited

U.S. PATENT DOCUMENTS 2,527,762 A 10/1950 Pratt
2,819,568 A * 1/1958 Kasick ..... B24D 7/10 451/511
3,754,359 A 8/1973 Scandaletos
5,423,717 A 6/1995 Boaz
5,609,516 A * 3/1997 Courson ..... B24B 55/102 451/359
6,007,415 A 12/1999 Van Osenbruggen
6,299,522 B1 10/2001 Lee
6,312,325 B1 11/2001 Van Osenbruggen
6,368,199 B1 4/2002 Van Osenbruggen
6,758,732 B1 7/2004 Hilton
8,562,396 B1 10/2013 Piliguian
(Continued)

FOREIGN PATENT DOCUMENTS

CN 205928190 U 2/2017
CN 206373745 U 8/2017
EP 2363241 A1 9/2011

OTHER PUBLICATIONS

European Search Report dated Jan. 13, 2021 in corresponding European Application No. 20192642.5.

*Primary Examiner* — Anne M Kozak
*Assistant Examiner* — Arman Milanian
(74) *Attorney, Agent, or Firm* — Harness, Dickey & Pierce, P.L.C.

(57) ABSTRACT

A cooling device for a rotating machine has a fan assembly coupled with a backing plate. A hub, on the backing plate, secures the cooling device with a shaft. The backing plate includes one or more vents to enable air to exit the cooling device. The fan includes an opening to enable air to enter the cooling device. A chamber is formed between the fan assembly and the backing plate. During rotation, air is drawn into the opening. The air is passed into the chamber and exits through the vents to cool a work surface or working pad attached to the backing plate.

16 Claims, 4 Drawing Sheets

(56) References Cited

U.S. PATENT DOCUMENTS

| | | | | |
|---|---|---|---|---|
| 9,302,365 | B2 * | 4/2016 | Valentini | B24B 55/102 |
| 2014/0242891 | A1 | 8/2014 | Kildevaeld, III | |
| 2015/0085174 | A1 | 3/2015 | Shabtay et al. | |
| 2016/0229033 | A1 * | 8/2016 | Brandstetter | B24D 13/142 |

* cited by examiner

COOLING DEVICE FOR A ROTATING POLISHING DISK

FIELD

The present disclosure relates to a polishing tool and, more particularly, to a cooling device for a rotating backing plate.

BACKGROUND

Polishing machines and sanding machines are routinely used in the automotive detailing industry and home building industry to correct imperfections in the paint or drywall and to apply polishes and waxes. There are three primary machines used, including, rotary buffers, random orbital machines and dual action machines. Each tool has its place, as the matter in which the pad spins on each machine is unique and used for different purposes.

Rotary buffers are the fastest and most effective machines for removing paint defects in a controlled manner with good results. The drive unit used in a rotary buffer is directly connected to the pad and each one is in axial alignment with each other. In order to correct paint scratches, the rotary buffer is commonly used to remove enough paint surrounding the scratch to make the surface level. Removing scratches, however, requires more skill and control of the machine than typical hobbyists possess. For this reason, rotary buffers are commonly avoid by average users as it is very easy to remove too much paint and damage the finish by causing swirl marks or by burning the paint.

Random orbital machines were introduced in order to meet the needs of an average user as they require less experience and control to operate. A random orbital machine uses a gear case that employs two unique mechanisms that move a pad attached to a backing plate. Unlike a rotary buffer, random orbital machines place the central rotational axis of the pad in the backing plate offset from the driveshaft of the machine. This offset is commonly referred to as the stroke. As a result, the backing plate and pad orbit the drive shaft in a circular motion. At the same time, the pad randomly spins as it is mounted on an idler bearing. This random spinning varies with pressure applied on the pad and is not directly powered. The result is a polishing action that will not burn or cut through the paint as it will not produce the heat from a powered spinning action. Random orbital machines are therefore much safer and dramatically less likely to cause swirl or burns through paints.

Similar to random orbital machines, dual action machines place the central rotation axis of the pad and the backing plate offset from the driveshaft. As a result of this stroke, the backing plate and pad orbit the driveshaft in a circular motion. However, with a dual action machine the spinning of the pad is directly powered. These machines all require a rotation of the pad.

During all polishing operations, extreme levels of heat are generated possibly damaging the working surface and/or polishing equipment. The present device provides an improved cooling device for cooling the polishing pad and work surface. A fan assembly is generally connected with a backing plate to provide pressurized air through the backing plate which, in turn, passes air through the polishing pad to the work surface. Pressure in the assembly accelerates the air and pushes it through the backing and polishing pads to the work surface cooling the work surface.

SUMMARY

In accordance with the first embodiment, a cooling device for a rotating polishing disk comprises a housing coupled with a backing plate. A hub is positioned on the backing plate to secure the cooling device with a shaft. The backing plate includes one or more vents to enable air to exit the cooling device. The housing includes a shroud with an opening to enable air to enter the cooling device. A separating plate is positioned between the shroud and the backing plate. A plurality of vanes are positioned between the shroud and the separating plate. The plurality of vanes draw air into the cooling device. A pressurized chamber is formed between the separating plate and the backing plate. During rotation, air is drawn in through the shroud opening by the plurality of vanes. Air is passed into the pressurized chamber and out through the vents to cool a working pad, attached to the backing plate, as well as the work surface. The hub projects through an aperture in the separating plate. The plurality of vanes are shaped as airfoils. The vanes have a rounded leading edge and a sharp trailing edge. Each vane extends from the shroud opening to a periphery of the separator plate. A gap is formed between a periphery of the separator plate and the shroud. A plurality of vents is in the backing plate. A foam pad is attached to the backing plate. Fasteners are on the form pad to secure the working pad. The housing is a one piece construction.

According to a second embodiment, a rotating polishing machine comprises a housing with a handle on the housing. A motor is positioned inside the housing. A rotating shaft extends from the motor. A backing plate is coupled with the shaft. A housing is coupled with a backing plate. A hub is positioned on the backing plate to secure the cooling device with a shaft. The backing plate includes one or more vents to enable air to exit the cooling device. The housing includes a shroud with an opening to enable air to enter the cooling device. A separating plate is positioned between the shroud and the backing plate. A plurality of vanes are positioned between the shroud and the separating plate. The plurality of vanes draw air into the cooling device. A pressurized chamber is formed between the separating plate and the backing plate. During rotation, air is drawn in through the shroud opening by the plurality of vanes. Air is passed into the pressurized chamber and exits out the vent to cool a working pad, attached to the backing plate, as well as the working surface. The hub projects through an aperture in the separating plate. The plurality of vanes are shaped as airfoils. The vanes have a rounded leading edge and a sharp trailing edge. Each vane extends from the shroud opening to a periphery of the separator plate. A gap is formed between a periphery of the separator plate and the shroud. A plurality of vents is in the backing plate. A foam pad is attached to the backing plate. Fasteners are on the form pad to secure the working pad. The housing is a one piece construction.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

The present invention and the various features and advantageous details thereof are explained more fully with reference to the non-limiting embodiments described in detail in the following description.

Figure 1:
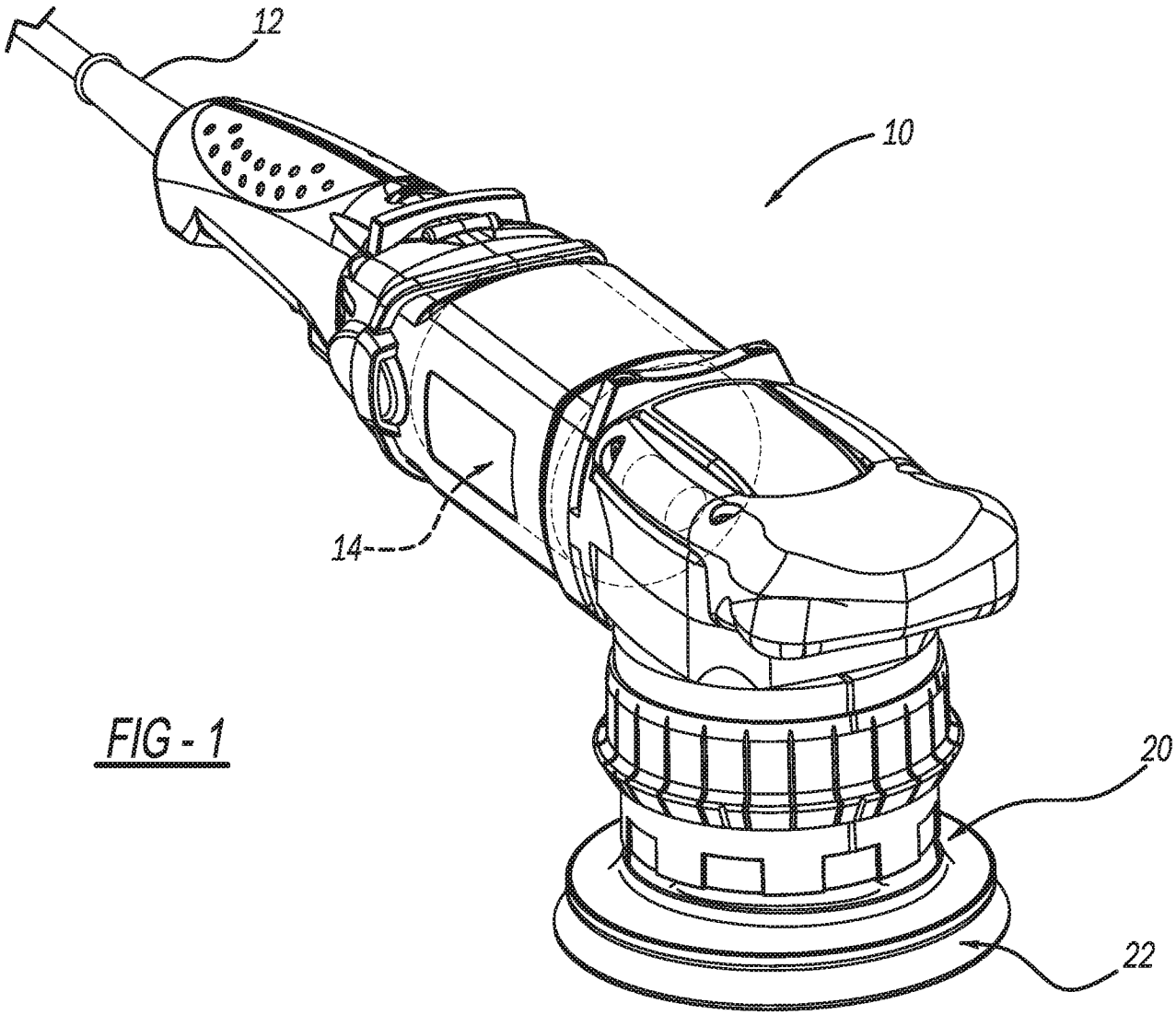
FIG. 1 is a perspective view of a rotating tool with a cooling device.
Figure 2:
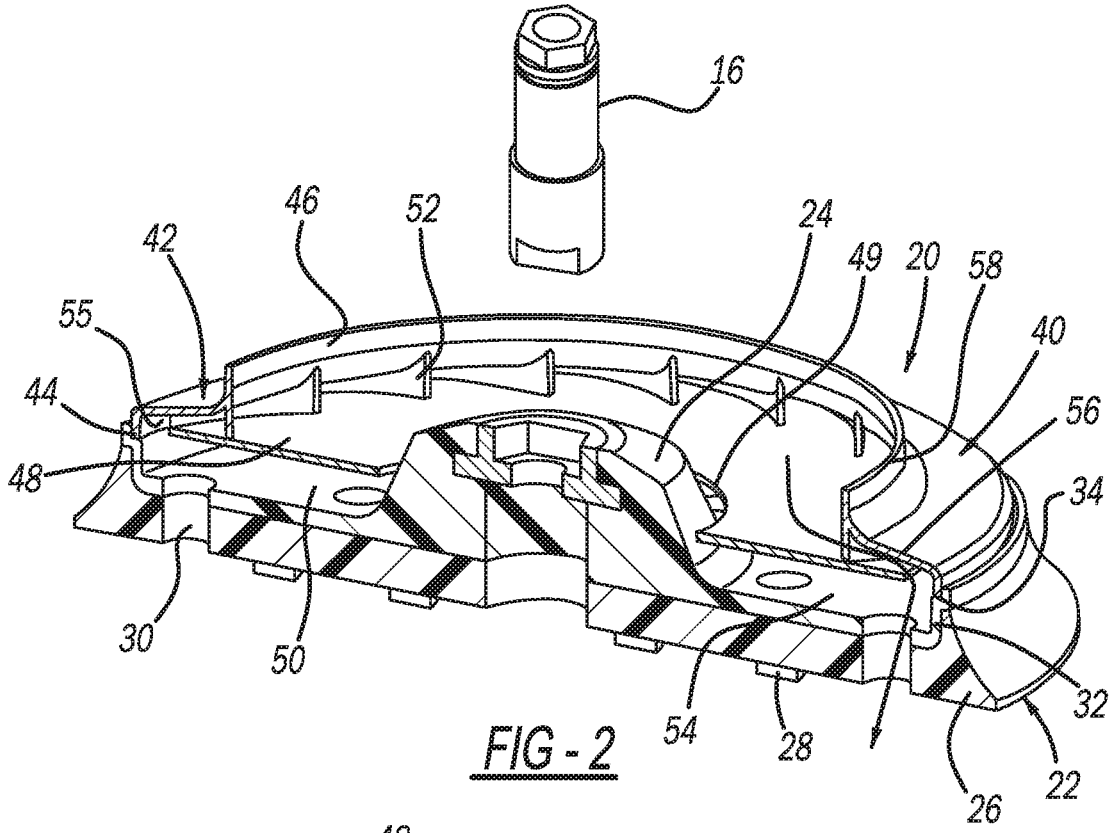
FIG. 2 is a cross-sectional view partially in perspective of the cooling device.
Figure 3:
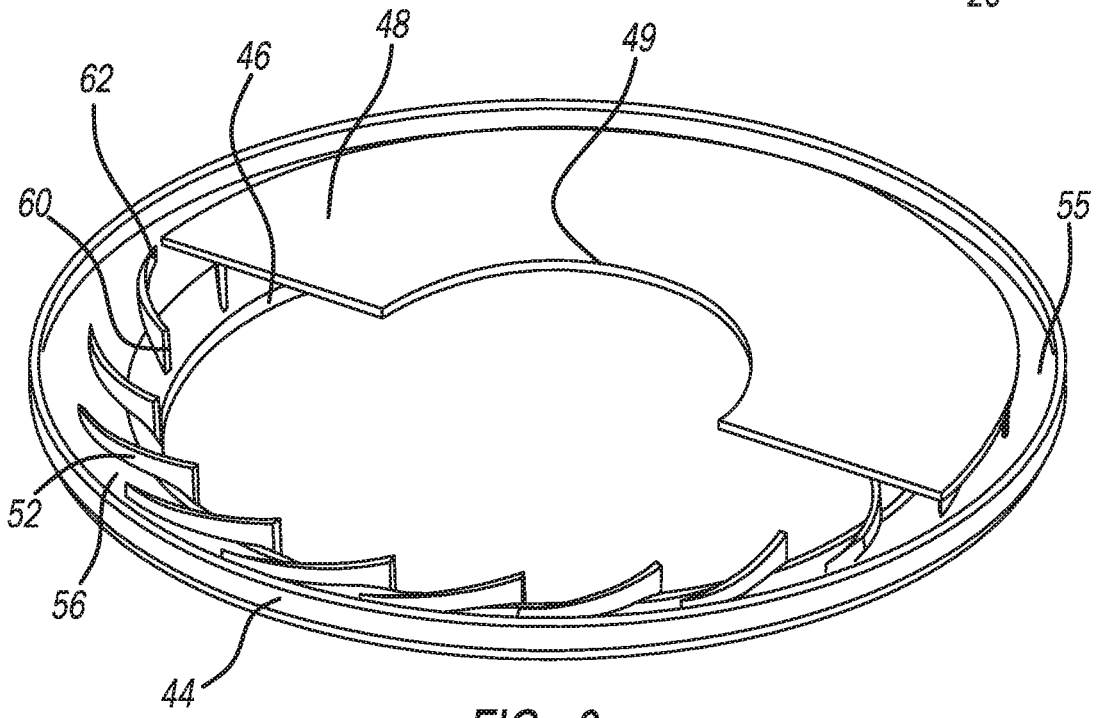
FIG. 3 is a perspective partially cross-section view of the cooling device.
Figure 4:
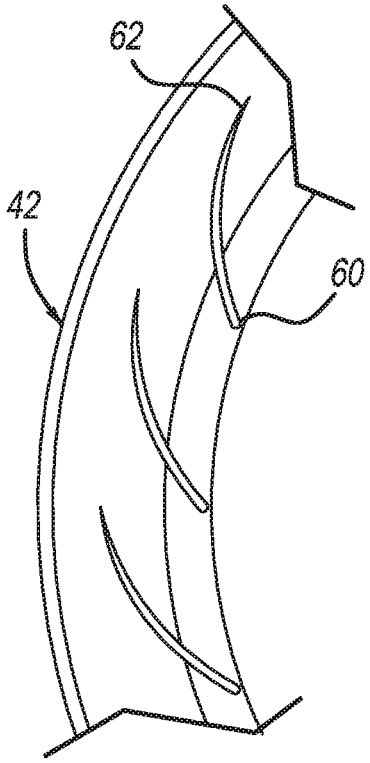
FIG. 4 is an enlarged perspective of the vanes view of FIG. 3.
Figure 5:
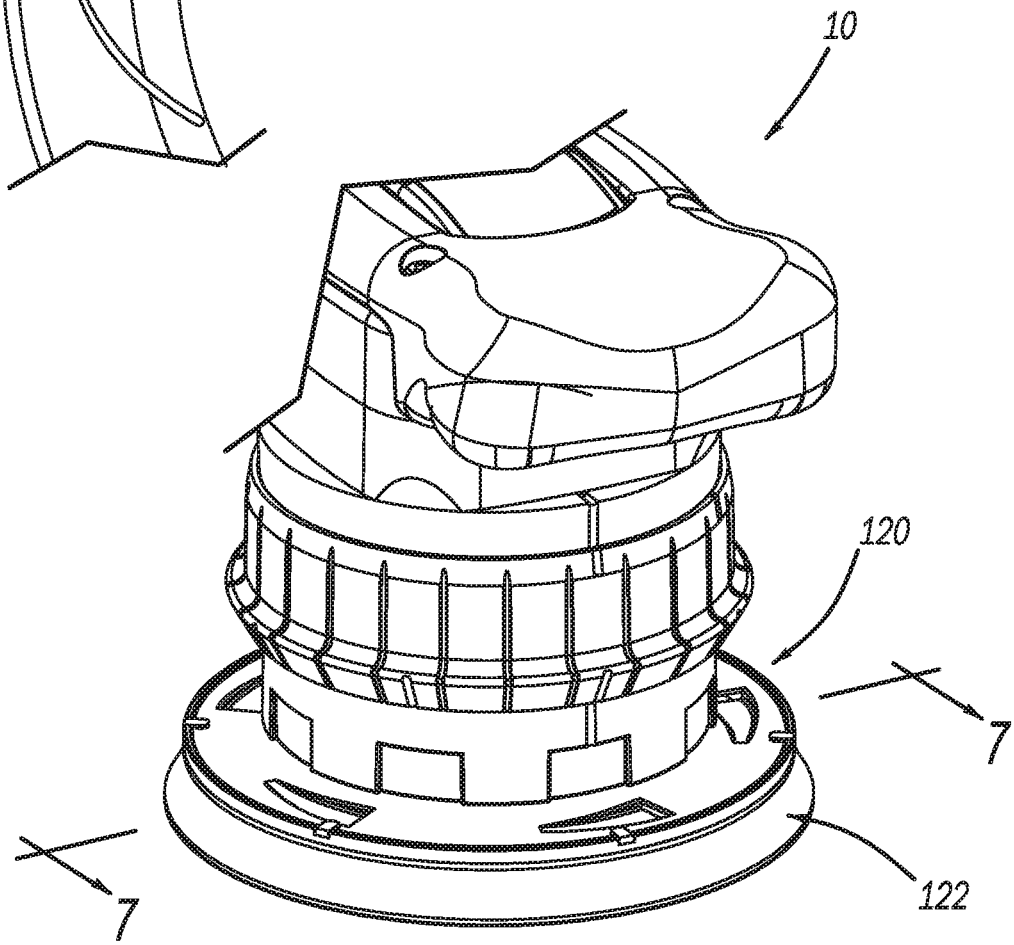
FIG. 5 is a perspective view of a rotating tool with a second embodiment of the cooling device.
Figure 6:
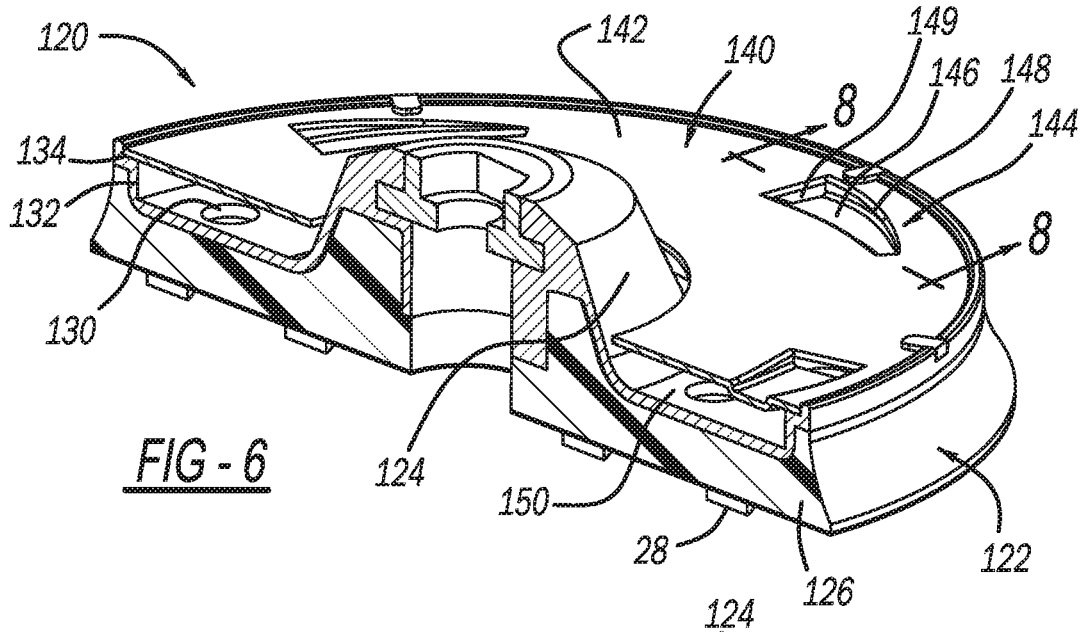
FIG. 6 is a cross-sectional view partially in perspective of the cooling device.
Figure 7:
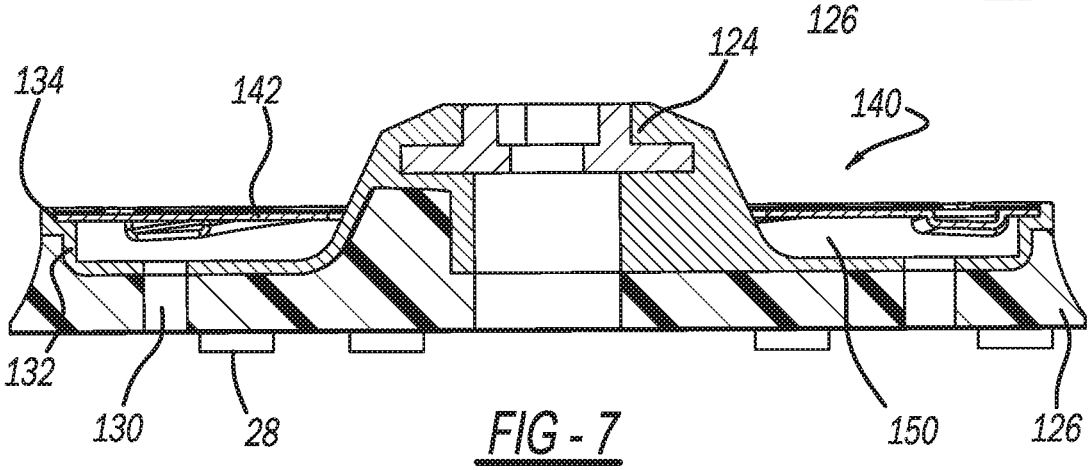
FIG. 7 is a cross-sectional view of FIG. 5 along line 7-7 thereof.
Figure 8:
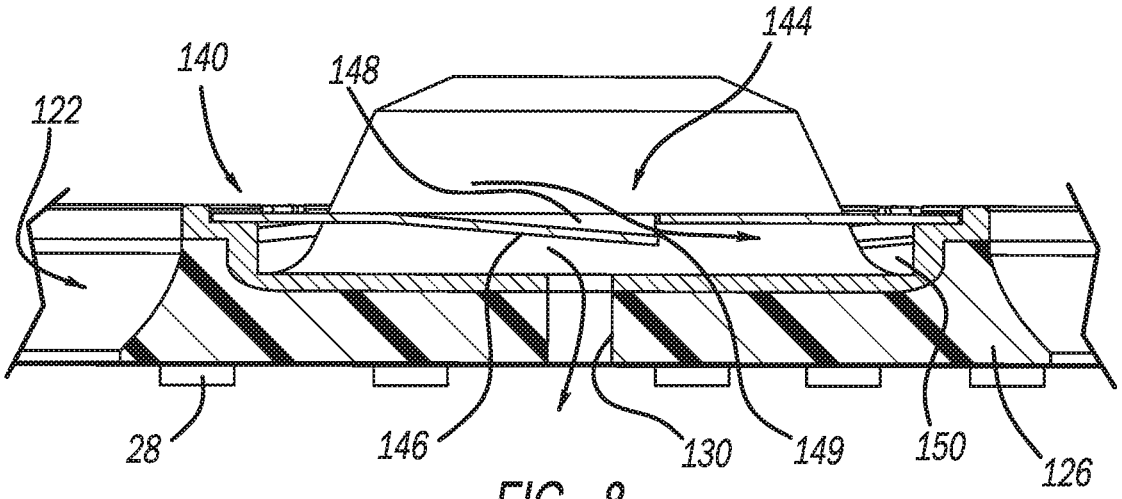
FIG. 8 is a cross-sectional view of FIG. 6 along line 8-8 thereof.

FIG. 1 illustrates a random orbital machine. The machine 10 is operable by plugging a power delivery device 12, which, in this case, is an electrical cord. A switch may be depressed that energizes a motor 14 that causes a drive shaft 16 to rotate. A cooling device 20 is illustrated attached to a backing plate 22 that are rotatably secured with the shaft 16.

The backing plate 22 includes a drive hub 24 that attaches the backing plate 22 to the spindle or rotating shaft 16. The backing plate 22 includes a foam pad 26 with a plurality of hook and loop fasteners 28 that enable the foam pad to attach a polishing pad. Also, the foam pad 26 includes a plurality of vents or apertures 30 that enable air to flow through the cooling device 20.

The backing plate 22 has an overall cylindrical shape with the hub 24 being elevated in this design at the center of the backing plate 22. The backing plate 22 also includes a side flange 32 with a step 34 to receive the fan assembly 40 of the cooling device 20.

The fan assembly 40 includes a housing or inlet shroud 42. The inlet shroud 42 has an overall circular ring shape with a flange 44 that meshes with the step 32 of the backing plate 22. The shroud 42 includes an opening 46 to enable air to enter into the fan assembly 40. A separating plate 48 is positioned above a surface 54 of the backing plate 22. This forms a chamber 50 between the backing plate 22 and the fan assembly 40.

A plurality of vanes 52 is positioned between the shroud 42 and the separating plate 48. The vanes 52 direct air entering through the opening 46 through the shroud 42 into the chamber 50 and out through the apertures 30. The shroud 42 includes a circular wall 56 that extends between the flange 44 and the opening 46. Additionally, a flange 58 extends upwardly from the wall 56 to define the opening 46. The vanes 52 are positioned between the wall 56 and the separating plate 48.

The separating plate 48 is circular and includes an aperture 49 to enable passage of the hub 24. The separating plate 48 extends radially towards the shroud flange 44 to provide a gap 55 between the two to enable passage of air.

The vanes 52 have an airfoil shape with a rounded end 60 and a terminating sharp edge 62. The rounded end 60 is positioned adjacent the opening 46. Thus, the airfoil shaped vanes 52 draw the air into the opening 46 and direct the air toward the flange 44. The air moves or travels between the separating plate 48 and the underside of wall 56 to the radial end of the separating plate 48. This enables the air to be accelerated and move from the opening 46 between the separating plate 48 and wall 56 through gap 55 into the chamber 50.

As the air enters into the opening 46, the vanes 52 accelerates the air. As the air moves into the chamber 50, the air pressure rises due to the acceleration of the air and the boundary of the chamber 50. The air in the chamber 50 is then accelerated out through the vents or apertures 30. As the air exits the apertures 30, the air enters into the polishing pad and appears at the work surface. This, in turn, enables the polishing pad as well as the work surface to be cooled by the air.

The fan assembly 40 may be a multi-piece construction or a one piece injection molded formed part. This enables rapid connection with a backing pad 22.

Turning to FIGS. 5-8, a second embodiment of the fan assembly of the cooling device 20 is shown. The elements with like features are shown with numerals increased by 100.

The cooling device 120 is illustrated attached to a backing plate 122 that are rollably secured with the shaft 16. The backing plate 122 includes a drive hub 124 that attaches the backing plate 122 to the spindle or rotating shaft 16.

The backing plate 122 includes a foam pad 126 with a plurality of hook and loop fasteners 28 that enable the foam pad to attach a polishing pad.

The foam pad 126 also includes a plurality of vents or apertures 130 that enable air to flow through the cooling device. The backing plate 122 has an overall circular cylindrical ring shape with the hub 24 being elevated in this design at the center of the backing plate 122. The backing plate 122 also includes a side flange 132 with a step 134 to receive the fan assembly 140 of the cooling device 120.

The fan assembly 140 includes a plate 142 having an overall circular ring design which enables the plate 142 to fit in the step 134 as well as to abut the hub 124. The plate 140 includes one or more naca ducts 144. The naca ducts 144 are formed to the plate 140. The naca ducts 144 may include a base 146, walls 148 and an opening 149. The base 146 is usually angled from the surface of the plate 142 towards the opening or aperture 149. The naca duct 144 acts as a scoop to provide a low drag air inlet design. Thus, as the cooling device 120 is rotated, air is forced into the chamber 50. The chamber 50 is formed between the plate 142 and the backing plate 122. Additionally, tabs 142 hold the plate 140 onto the backing plate 122.

As the fan assembly 120 is rotated, air is accelerated along the naca duct 144 into the opening 149. As this occurs, the air moves into the chamber 150. The air pressure raises due to the acceleration of the air and the boundary of the chamber 150. The air in the chamber 150 is then accelerated out through the vents or apertures 130. As the air exits the apertures 130, the air enters into the polishing pad and appears at the work surface. This, in turn, enables the polishing pad, as well as the work surface, to be cooled by the air. The fan assembly 140 may be a multi-piece construction or a one piece injection molded form part. This enables rapid connection with the backing pad 122.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cooling device for a rotating machine comprising:

a fan assembly coupled with a backing plate;

the backing plate including one or more vents to enable air to exit the cooling device;

the fan assembly including an opening to enable air to enter the cooling device;

a chamber formed between the fan assembly and the backing plate; and the fan assembly including a shroud with the opening to enable air to enter the cooling device;

a separating plate positioned between the shroud and the backing plate;

a plurality of vanes positioned between the shroud and the separating plate, the chamber is formed between the separating plate and the backing plate; and during rotation of the cooling device, the plurality of vanes are configured to draw air into the cooling device through the fan opening into the chamber and out of the one or more vents in the backing plate to cool a work surface or working pad attached to the backing plate.

2. The cooling device according to claim 1, wherein a backing plate hub projects through an aperture in the fan assembly.

3. The cooling device according to claim 1, further comprising a foam pad attached to the backing plate.

4. The cooling device according to claim 1, wherein the fan assembly is of a one piece construction.

5. The cooling device according to claim 1, wherein each one of the plurality of vanes is shaped as an airfoil and each vane extends from the shroud opening to a periphery of the separator plate.

6. The cooling device according to claim 1, wherein a gap is formed between a periphery of the separator plate and the shroud.

7. The cooling device according to claim 1, the fan assembly further comprising a housing plate having one or more naca ducts defining the opening enabling air to enter the cooling device.

8. The cooling device according to claim 7, wherein the housing plate is coupled with the backing plate forming the chamber therebetween.

9. A rotating polishing machine comprising:

a housing;

a handle on the housing;

a motor positioned in the housing;

a rotating shaft extending from the motor; and a cooling device comprising:

a fan assembly coupled with a backing plate;

the backing plate including one or more vents to enable air to exit the cooling device, a hub on the backing plate for securing the cooling device with the shaft;

the fan assembly including an opening to enable air to enter the cooling device;

a chamber formed between the fan assembly and the backing plate; and the fan assembly including a shroud with the opening to enable air to enter the cooling device;

a separating plate positioned between the shroud and the backing plate;

a plurality of vanes positioned between the shroud and the separating plate, the chamber is formed between the separating plate and the backing plate; and during rotation of the cooling device, the plurality of vanes are configured to draw air into the cooling device through the fan opening into the chamber and out of the one or more vents in the backing plate to cool a work surface or working pad attached to the backing plate.

10. The rotating machine according to claim 9, wherein the hub projects through an aperture in the fan assembly.

11. The rotating machine according to claim 9, further comprising a foam pad attached to the backing plate.

12. The rotating machine according to claim 9, wherein the housing is of a one piece construction.

13. The cooling device according to claim 9, wherein each one of the plurality of vanes is shaped as an airfoil and each vane extends from the shroud opening to a periphery of the separator plate.

14. The cooling device according to claim 9, wherein a gap is formed between a periphery of the separator plate and the shroud.

15. The rotating machine according to claim 9, the fan assembly further comprising a housing plate having one or more naca ducts defining the open enabling air to enter the cooling device.

16. The cooling device according to claim 15, wherein the housing plate is coupled with the backing plate forming the chamber therebetween.

* * * * *